United States Patent [19]

Wright

[11] 4,014,385

[45] Mar. 29, 1977

[54] PLATE HEAT EXCHANGERS

[75] Inventor: Felix William Wright, Copthorne Bank, near Crawley, England

[73] Assignee: The A.P.V. Company Limited, Crawley, England

[22] Filed: May 21, 1975

[21] Appl. No.: 579,451

[30] Foreign Application Priority Data

May 24, 1974 United Kingdom ..... 23405/74

[52] U.S. Cl. ..... 165/167

[51] Int. Cl.[2] ..... F28F 3/08

[58] Field of Search ..... 165/167, 166

[56] References Cited

UNITED STATES PATENTS

| | | | |
|---|---|---|---|
| 2,550,339 | 4/1951 | Ehrman | 165/167 |
| 2,787,446 | 4/1957 | Ljungstrom | 165/167 |
| 3,661,203 | 5/1972 | Mesher | 165/167 |
| 3,731,737 | 5/1973 | Jennssen | 165/167 |
| 3,792,730 | 2/1974 | Andersson | 165/167 |

FOREIGN PATENTS OR APPLICATIONS

| | | | |
|---|---|---|---|
| 509,867 | 2/1955 | Canada | 165/167 |

*Primary Examiner*—C. J. Husar
*Assistant Examiner*—Theophil W. Streule, Jr.
*Attorney, Agent, or Firm*—Christel & Bean

[57] ABSTRACT

A plate for a plate heat exchanger, the said plate including a principal heat exchange zone, a pattern of corrugations in the heat exchange zone, the said pattern of corrugations being adapted to cross and abut with a corresponding pattern of corrugations on a plate of a similar type to provide interplate support and turbulence in liquid flowing in a flow space formed by two said plates, in which the corrugations are locally increased in stiffness adjacent the intended points of abutment with the corrugations of an adjacent plate by varying the cross-section to increase the curvature at these locations.

3 Claims, 7 Drawing Figures

PLATE HEAT EXCHANGERS

This invention relates to plate heat exchangers.

In the type of plate heat exchanger to which this invention relates, a pack of plates is arranged in clamped and separable face-to-face relationship to form flow spaces between adjacent plates, the flow spaces being bounded by peripheral gaskets on the plates. Supply and discharge of heat exchange media are through supply and discharge ports defined by aligned apertures in the plates and gasketing is arranged so that alternate flow spaces connect the supply and discharge ports for one medium and the intervening flow spaces connect the supply and discharge ports for the other medium. In order to create turbulence in the flow passages with the object of increasing heat transfer, the plates are usually provided with ribs and troughs. The ribs and troughs of adjacent plates cross and abut to provide a region in which turbulence of the flow stream is created by continued subdivision and commingling of the flow and where good interplate support is given by the closely spaced points of abutment, whereby the heat exchanger can be used with comparatively high operating pressures when the plates are clamped together.

Both the degree of turbulence and the ability of the plate to resist fluid pressure are affected by the shape and spacing of the ribs and troughs. It is common practice to design the ribs and troughs to have a somewhat sinusoidal cross-section having arcuate upper and lower portions connected by a common tangent. When the spacing is large the radius of the arcuate portions also becomes large whence the load bearing capacity of the contact points is reduced.

According to a first aspect of the present invention, there is provided a plate for a plate heat exchanger, the said plate including a principal heat exchange zone having a pattern of corrugations adapted to cross and abut with a corresponding pattern of corrugations on a plate of a similar type to provide interplate support and turbulence in liquid flowing in a flow spaced formed by two said plates, in which the corrugations are locally increased in stiffness adjacent the intended points of abutment with an adjacent plate by varying the cross-section to increase, i.e. sharpen, the curvature at these locations.

According to a second aspect of the invention, there is provided a plate heat exchanger comprising a pack of plates according to the invention as set forth above having their corrugations crossing and abutting with those of adjacent plates in the regions of local stiffening.

The local stiffening will also tend to reduce the area of contact between adjacent plates so that the areas of contact will have a reduced tendency to foul, and will probably also be easier to clean by the normal chemical cleaning techniques. There may also be a marginal improvement in heat transfer performance.

The invention will be further described with reference to the accompanying drawings, in which.

Figure 1:
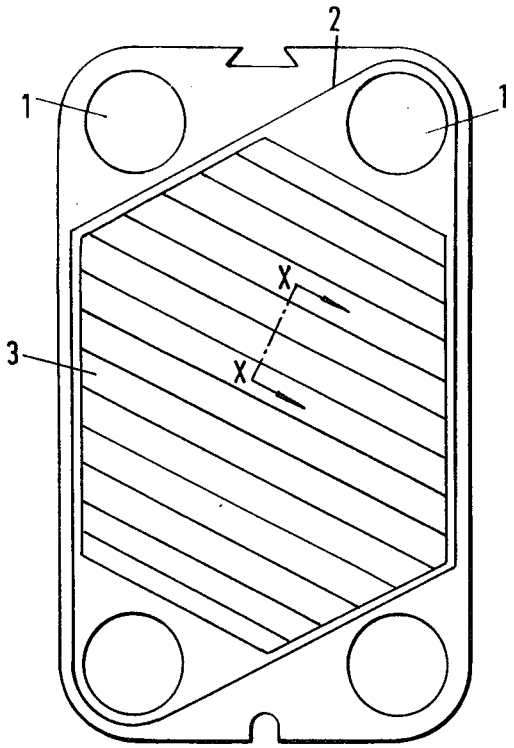
FIG. 1 is a diagrammatic elevation of a typical heat transfer plate to which the invention may be applied.

FIG. 1 shows a plate having corner ports 1 and a peripheral gasket 2 defining the boundary of a flow space 3 and also isolating two ports from the flow space and allowing the other two to communicate therewith. The flow space is provided with a pattern of corrugations, i.e. alternate ribs and troughs, to aid in the promotion of turbulence and to provide interplate support by crossing and abutting with corrugations of adjacent plates.

Figure 2:
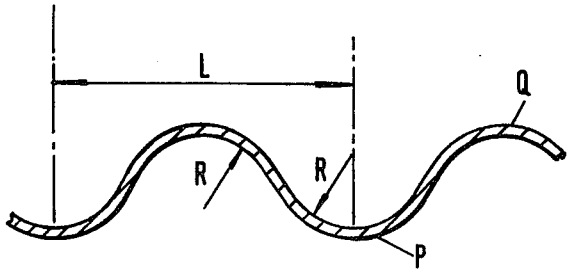
FIG. 2 is a section on the line X — X of FIGS. 1, 5 and 7.
Figure 3:
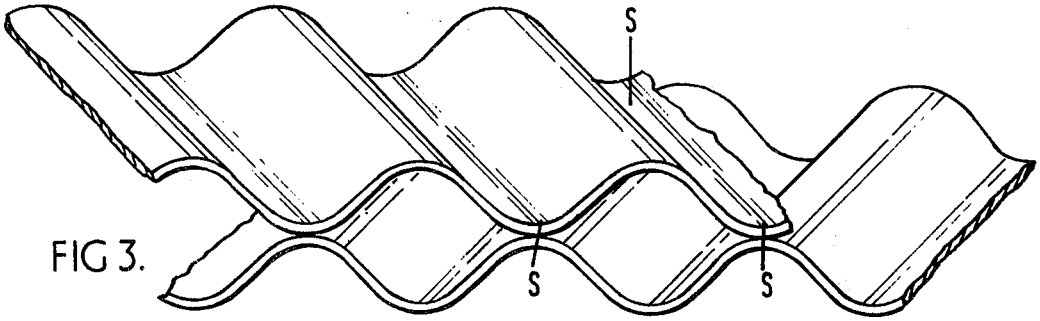
FIG. 3 is a sectional perspective view showing the relationship between corrugations of two adjacent plates in a pack.

FIG. 2 shows a section as a X — X of FIG. 1 in which the upper or rib portions of this region is denoted Q and the lower or trough portions are denoted P. The corrugations of adjacent plates are arranged at some angle so that the ribs Q of one plate contact the troughs P of the adjacent plate in a decussate manner, as indicated at points S in FIG. 3. This process is repeated by the addition of more plates.

In those cases where the desired thermal performance of the plate requires high turbulence, the spacing pitch L of FIG. 2 is small and the radius R becomes small. As a consequence the ribs Q and troughs P are mechanically stiff so that distortion at the contact points S arising from clamping and hydraulic forces is minimal. When the thermal specification calls for ribs and troughs at greater pitching, the radius R becomes larger, leading to a reduction in stiffenss. Accordingly, the hydraulic pressure collapse of the ribs and troughs at the contact points may occur to such an extent that the spacing of adjacent plates becomes unequal. According to the present invention, this weakness is overcome by stiffening the corrugations by sharpening in the locality of each contact whilst leaving the remainder of the form unaltered.

Figure 4:
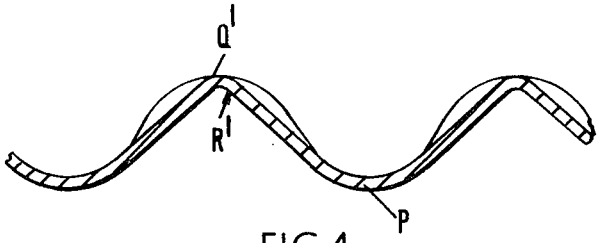
FIG. 4 is a view similar to FIG. 2, but showing local stiffening in accordance with a preferred form of the invention, and is taken on the line Y — Y of FIGS. 5 and 7.
Figure 5:
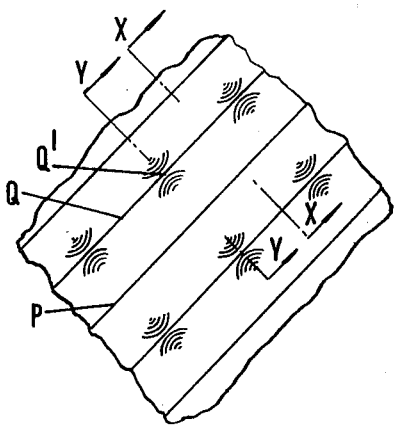
FIG. 5 is a scrap elevational view showing local stiffening on rib contours only.
Figure 6:
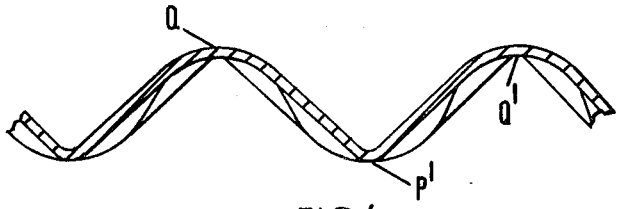
FIG. 6 is a further sectional view, taken on line Z — Z of FIG. 7.
Figure 7:
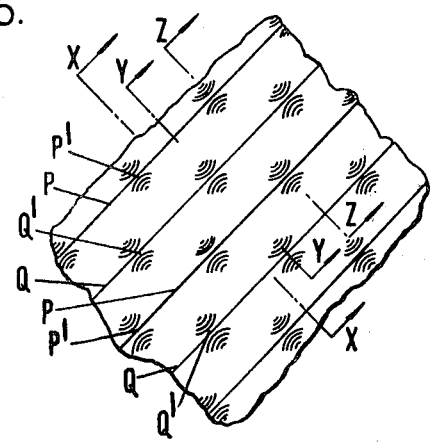
FIG. 7 is a scrap elevational view showing local stiffening of both rib and trough contours.

Referring to FIG. 4, which is a section Y — Y of FIGS. 5 and 7, the rib radius R is reduced locally to $R^I$ resulting in a sharpening of the form to $Q^I$ and which is indicated along the ribs of FIGS. 5 and 7. Applying a similar change to the troughs, these also become locally sharpened to $P^I$ as in FIG. 6 which is section Z — Z of FIG. 7.

It is a principle of the invention that the sharpening of form is situated where contacts S are made with adjacent plates and is restricted in extent so that the thermally desirable arcuate rib and trough form is retained over most of the plate surface and further that by means of the sharpening local stiffness of the pressing is increased whereby the load bearing capacity of the corrugations is increased.

The local stiffening may be achieved during pressing by relieving the die faces of the press tools in the regions where local sharpening is required.

Various modifications may be made within the scope of the invention. For instance, it will be understood that the invention is not limited solely to plates with rectilinear corrugations, but may also be applied to plates having angled, e.g. herring-bone or W formation, patterns of corrugations, and also to patterns of arcuate corrugations.

I claim:

1. A plate heat exchanger comprising a pack of plates arranged in spaced, face-to-face relationship, the said plates each including a principal heat exchange zone, a pattern of corrugations in the heat exchange zone, the said pattern of corrugations crossing and abutting with the corresponding pattern of corrugations on an adjacent plate to provide interplate support and turbulance in liquid flowing in a flow space formed by said plates, in which the corrugations are locally increased in stiffness at longitudinally spaced locations along the corrugations and on at least one of said plates at the points of abutment with an adjacent plate by varying the cross-section to sharpen the curvature of the corrugations at these locations.

2. A plate heat exchanger as claimed in claim 1, in which both the ribs and the troughs of the corrugations are locally increased in stiffness.

3. A plate heat exchanger as claimed in claim 1, in which the corrugations are locally increased in stiffness on both of said plates at the points of abutment.

* * * * *